United States Patent [19]

Furch et al.

[11] Patent Number: 4,612,859

[45] Date of Patent: Sep. 23, 1986

[54] MULTIPLE PURPOSE WARHEAD

[75] Inventors: Benjamin Furch, Unterlüss; Jens Seidensticker, Kaarst, both of Fed. Rep. of Germany

[73] Assignee: Rheinmetall GmbH., Duesseldorf, Fed. Rep. of Germany

[21] Appl. No.: 659,649

[22] Filed: Oct. 11, 1984

[30] Foreign Application Priority Data

Oct. 11, 1983 [DE] Fed. Rep. of Germany ..... 3336853

[51] Int. Cl.[4] ..... F42B 11/22

[52] U.S. Cl. ..... 102/476; 102/306; 102/491

[58] Field of Search ..... 102/306–310, 102/491, 476

[56] References Cited

U.S. PATENT DOCUMENTS

| | | | |
|---|---|---|---|
| 3,474,731 | 10/1969 | Thomanek | 102/476 |
| 3,662,684 | 5/1972 | Bodinaux | 102/476 |
| 4,306,502 | 12/1981 | Romer et al. | 102/309 |

FOREIGN PATENT DOCUMENTS

| | | | |
|---|---|---|---|
| 2385074 | 11/1978 | France | 102/476 |

*Primary Examiner*—Harold J. Tudor

[57] ABSTRACT

The invention relates to a multiple purpose warhead which is provided with a spike-forming cladding, with projectile-forming layers and with preshaped splinters, respectively splinter layers. For the simultaneous combatting of hard and semi-hard material targets as well as soft targets the impact precision, the penetration capacity and thereby the effectiveness of the multiple purpose warhead is increased relative to the multiple purpose warheads of the state of the art.

The multiple purpose warhead of this invention includes within a multiple purpose warhead casing 7 at least three effective parts 1, 2, 3. This arrangement achieves optimum, however, different, target effectiveness and a separate dosable explosive charge 6.1, 6.2, 6.3 corresponding to the different target requirements by providing corresponding different claddings for each effective part. There is provided between a first effective part formed as a hollow charge 6.1 and a third effective part formed as a splinter-forming warhead 9 a projectile-forming layer 22 which forms the second effective part. There is provided within two mutually confronting conically shaped recesses 10, 11 arranged symmetrically about a longitudinal axis 12, on the one hand, an ignition arrangement 14 and, on the other hand, an inert-insert 13, whereby a common ignition of all effective parts is made possible and flaw-free detonation wave guidance is also effected not only with a spike-formation, but also with the projectile-formation thereby increasing the destructive capacity of the multiple purpose warhead.

4 Claims, 3 Drawing Figures

MULTIPLE PURPOSE WARHEAD

BACKGROUND OF THE INVENTION

The invention relates to a multiple purpose warhead adapted for use against combatting military personnel and mobile, respectively immobile armored targets. Such a multiple purpose warhead is described in German published patent application No. 2205074. In the known multiple purpose warhead there is only provided one detonating charge within a detonating casing which has a forwardly directed spike-shaped hollow charge cladding, a plurality of projectile-forming layers disposed perpendicular with respect to the longitudinal axis of the detonating charge and warhead, and on the remaining exposed casing there can be provided portions of the detonating charger. For example, spherically shaped splinters can be provided as a splinter layer. In such an arrangement there may occur negative influences at detonation which is at a point in time at which they detract from the penetration capacity and impact precision of the warhead. For example, the spike-forming hollow charge cladding is subject to such negative influences which appear in the form that when forming the spike at detonation no detonation wave guiding is provided. Moreover, these operational flaws causing a disturbance of the hollow charge development cannot be avoided because a uniform firing is not achievable due to the distorted formation of the pressure waves as a result of detonating charge smoke generation. The hot generated detonating smoke and by circulating particles of the splinter layer also prevent an avoidance of an inhibition of the hollow charge spike. As a result, the splinter layer reduces the available space of the detonating charge disposed above the spike-forming hollow charge which causes a further reduction of the penetration capacity of the hollow charge cladding.

Also the impact precision of the projectile-forming layer is negatively influenced because the curvature of the detonating charge casing causes the detonating waves not to impact rotationally-symmetrically with respect to the axis of the layer.

The arrangement of a single detonating charge within the detonating charge casing does not permit to optimally distribute and dose the energy for attaining different layer-specific detonating velocities.

SUMMARY OF THE INVENTION

It is a general object of this invention to improve the impact precision and penetration capacity and thereby the effectiveness of a multiple purpose warhead for combatting hard, semi-hard and soft targets.

This object is achieved by advantageously constructing various parts of the multiple purpose warhead. The multiple purpose warhead advantageously distinguishes itself in accordance with this invention in providing a simple construction having various parts of equal diameter each of which has a different type of cladding or layer which different layers are arranged one behind the other in a pipe-like multiple purpose warhead casing. Such a novel multiple purpose warhead has detonating energies of the respective detonating charges which provide the necessary detonating velocities which are adapted and dosed according to the different respective claddings and layers. A further advantage resides in that the multiple purpose warhead casing is suitable for a simultaneous combatting of hard, semi-hard and soft targets and has at least three different effective parts, whereby between a first effective part having a spike-shaped cladding and a third effective part having a preformed splinter layer, a second effective part is arranged which has a projectile-forming layer. The arrangement has bilaterally outwardly open conically shaped recesses which are symmetrical with respect to a longitudinal axis of the multiple purpose warhead, whereby the recess which extends within the first effective part has an inert-insert disposed therein and the recess which extends into the third effective part has an ignition arrangement disposed therein.

By disposing the inert arrangement within the conically shaped recess of the second effective part there is prevented that hot powder smoke particles of the following effective parts impinge on the central region of the detonating charge end face of the hollow charge. The inert insert permits by its central position and its smaller exterior diameter relative to the diameter of the hollow charge to effect a ring-shaped ignition and a detonation wave guide of the hollow charge, whereby the first effective part which carries the hollow charge can be considerably shortened by abolishment of the inert insert.

By advantageously arranging the ignition fuse in a first conically shaped recess which corresponds to the second conically shaped recess of the second effective part and by arranging a detonator between the confronting points of the conically shaped recesses, there is furthermore advantageously only required a single ignition fuse for the adjacent first and third effective parts. The confronting conically shaped recesses are rotational symmetrical with respect to the axis of the projectile-forming layers, whereby the detonation waves impinge nearly perpendicularly on the layers, so that even large layers can be produced as projectiles having penetration capacity in an exactly predetermined direction.

Depending on the spatial relationships in the multiple purpose warhead and on the requirements of the targets that are to be combatted, there can be arranged further effective parts behind the third effective part. Advantageously, each fourth and subsequent projectile-forming charges forming effective parts can be received in a conically shaped recess and be in form of a metal in lieu of an inert-insert, which, on the one hand, can absorb the acceleration forces, which act on the explosive material of the projectile forming charge, and on the other hand initiate (ignite) the adjoining effective part. It is also possible to fill the hollow space within the metal insert with a suitable ballast-material for transferring the acceleration forces.

BRIEF DESCRIPTION OF THE DRAWING

With these and other objects in view, which will become apparent in the following detailed description, the present invention, which is shown by example only, will be clearly understood in connection with the accompanying drawings, in which.

DETAILED DESCRIPTION

Figure 1:
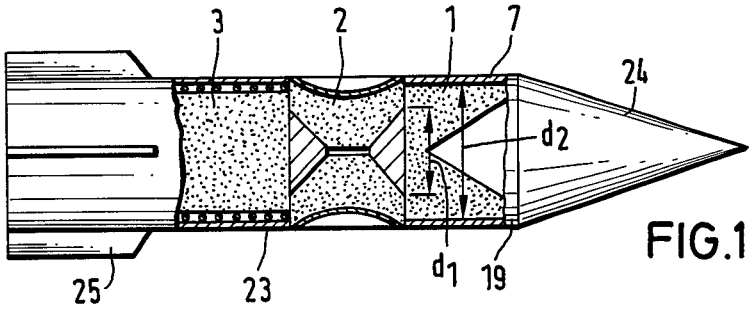
FIG. 1 illustrates partially in cross-section and side-elevation an arrangement of a multiple purpose warhead forming part of a flying body.
Figure 3:
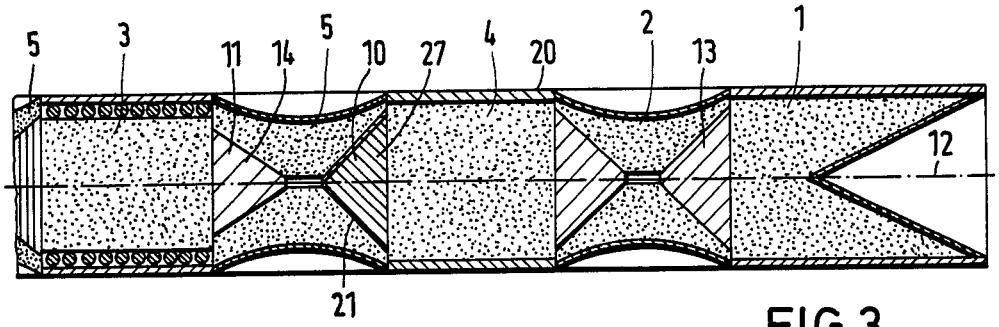
FIG. 3 is a longitudinal section of a multi purpose warhead which has more effective parts than the multiple purpose warhead illustrated in FIG. 2.

FIG. 1 illustrates in detail a flying body 19 having effective parts 1, 2 and 3 which jointly form the multiple purpose warhead 23 disposed within a multiple purpose warhead casing 7 forming the flying body 19. The effective parts 1, 2 and 3, respectively 1, 2, 3, 4, and 5 (FIG. 3) are disposed between the ballistic hood 24 and a tail fin or wing-stabilization arrangement 25. The arrangement of the effective parts 1, 2 and 3 in a guided flying body or missile 19, whose guide ignnition and steering mechanism has not been illustrated in detail because it is not crucial to the invention. This multiple purpose warhead permits an optimum and effective combatting of strong and weakly armored targets as well as soft targets disposed at great distances. The arrangement of the effective parts within a type of ammunition which can be fired from a gun barrel, forms part of the invention. The effective parts 1, 2, 3 may be provided at their rear with a bottom member (not illustrated) in lieu of the illustrated fin or guide stabilization arrangement (not illustrated) and at the front (also not illustrated) sensor.

Figure 2:
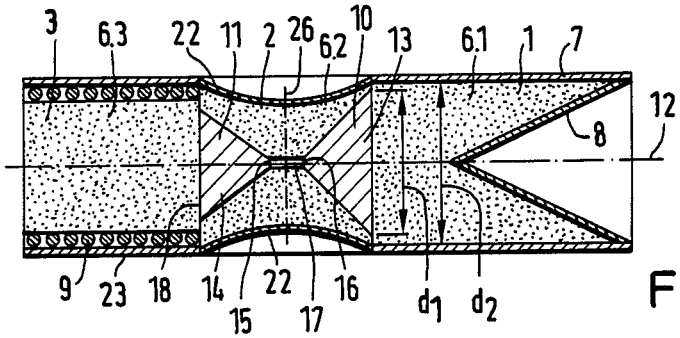
FIG. 2 is a longitudinal section of a multiple purpose warhead containing three effective parts.

FIG. 2 illustrates in detail the construction of a three-part multiple warhead 23 having three different effective parts 1, 2, 3 arranged within a pipe-shaped multiple warhead casing 7 of uniform diameter. Despite the fact that each one of the effective parts 1, 2, 3 has an individual distinct construction, for example, each one having a corresponding specific type of layer-detonating charge 6, which can be differentiated from each other with respect to their composition and explosive effect, so that the different types of layers, 8, 9, 22, provided for the different effective parts 1, 2, 3 form a common ignitable multiple purpose warhead 23 with high effectiveness for simultaneously combatting hard, semi-hard and soft targets.

The nose point of the multiple purpose warhead 23 is formed by the effective part 1 having a hollow charge 6.1 and a conically-shaped hollow charge cladding 8 which is rotationally-symmetrical with respect to the longitudinal axis 12. Behind the effective part 1 there is arranged a second effective part 2 having a plurality of projectile-forming layers 22. The layers 22 can be structurally differentiated with respect to their wall thickness, their composition of material, and their number and shapes; in all cases there is, however, provided the corresponding layer 22 symmetrically with respect to an axis 26 which is perpendicular to the longitudinal axis 12. The detonating charge 6.2 includes a pair of opposite outwardly opening conically shaped recesses 10, 11 aranged symmetrically with respect to the longitudinal axis 12 whereby an inert-insert 13 is disposed within the recess 10 confronting the effective part 1 and within the recess 11, confronting the effective part 3, there is arranged an ignition arrangement 14. The maximum diameter $d_1$ of the inert-insert 13 arranged in the effective part 2 is dimensioned in such a way with respect to the outer diameter $d_2$ of the effective part 1, that the ring-formed firing of the spike-shaped cladding 8 is possible. The inert-insert 13 prevents simultaneously, that hot detonating smoke or particles impinge on the central region of the detonating material end face of the hollow charge 6.1. Within the identically-shaped, however, mirror-arranged conically shaped recess 11 relative to the recess 10 there is disposed a conventional ignition arrangement 14 which is safety releasable in dependence to the different physical sizes, by means of which a saftey-release position of a conventional detonator 17 arranged centrally and rotationally-symmetrical with respect to the longitudinal axis 12 between the mutually confronting points 15 and 16 of the conically shaped recesses 10, 12 of the detonating charge 6.2 can be ignited. By means of this ignition process there can also simultaneously be ignited the adjoining detonating charges 6.1 and 6.3.

The recess 10 permits in addition to an optimal detonation wave guidance, for purposes of forming and ejecting a target-directed projectile from the layers 22, to also accommodate the inert-insert 13, whereby the effective part 1 can be constructionally simplified and substantially shortened while providing a high target impact precision without, however, having to carry the inert-insert 13.

The cylindrically-shaped effective parts 1, 2 permit to adjoin to the side 18 of the effective part 2 rows of pre-formed splinters 9 of further cylindrically shaped effective parts 3 or 4 (FIG. 3) having a splinter layer 20. Depending on the spatial conditions in the warhead and the requirements of the target, further effective parts 5, 3 or 4 can be adjoined to the third effective part. The projectile-forming effective part 5 requires also, as does the effective part 2, an initiation ignition in their central region. For this purpose each effective part 5 is provided with a separate ignition arrangement 14. The effective parts 3, 4, in contradistinction thereto, which are provided with spheres or balls or preformed splinters, do not require separate ignition but can be advantageously fired or ignited by the other effective parts.

As a result of providing the hollow space 10 of the effective part 5 with a metal layer 21 the latter can initiate (ignite) the adjoining effective parts 3, respectively 4, like a hollow charge. The effective part 5 is thereby constructed as a fourth, respectively alternating portions. The metal insert 21 is thereby simultaneously in a position to absorb the acceleration forces which act on the explosive material of the effective part 5. In lieu of the metal insert 21 another suitable material can be used as a dampening material. For transferring the acceleration forces the hollow space 10 of the effective part 5 can also be filled with a suitable ballast-composition 27. The acceleration forces which are to be absorbed by the hollow space 11 of the effective parts 2, 5 are received in an advantageous manner from a housing of the ignition arrangement 14 which corresponds in shape to the hollow space 11.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as well now be apparent to those skilled in the art.

We claim:

1. An improved multiple purpose warhead having at least three combat-effective cylindrically shaped portions of equal diameter arranged in axial alignment one behind the other in said warhead, each one of said portions including an explosive charge as well as a different type of cladding, the front-most first portion having a forwardly directed open spike-shaped cladding and a hollow charge, a second portion adjoins said first portion and has an outer layer as well as ignition means operatively connected to said explosive charges disposed in said three portions for simultaneously igniting them, the improvement comprising said outer layer of the second portion has projectile forming characteristics, the explosive charge of said second portion has two symmetrical axially extending conical recesses whose apices confront each other and whose bases confront the respective axial ends of said warhead, the diameter $d_1$ of said bases is smaller than the diameter $d_2$ of said explosive charges which are respectively operatively mounted in said first and third portions, whereby said difference in diameters $d_2-d_1$ is such that upon detonation of the explosive charge in said second middle portion a ring-shaped simultaneous detonation of the explosive charges in said first and third portions is effected, and said conical recess in said second portion whose base confronts said first portion has an inert conical insert.

2. The improvement in a multiple purpose warhead as set forth in claim 1, wherein said ignition means are disposed between the confronting points of the conically shaped recesses in the second portion.

3. The improvement in a multiple purpose warhead as set forth in claim 1, wherein said third portion includes a splinter forming layer.

4. The improvement in a multiple purpose warhead as set forth in claim 3, wherein a fourth portion and more additional effective portions are provided, wherein each alternating portion adjoining said fourth portion has a conically shaped recess in which a metallic insert is disposed for the central ignition of the adjoining portion.

* * * * *